US006371193B1

(12) United States Patent
Goodman

(10) Patent No.: US 6,371,193 B1
(45) Date of Patent: Apr. 16, 2002

(54) CONTOURED RIGID VANE FOR ARCHITECTURAL COVERING

(75) Inventor: Barry Goodman, Boca Raton, FL (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 09/754,964

(22) Filed: Jan. 4, 2001

(51) Int. Cl.[7] ..... E06B 3/12

(52) U.S. Cl. ..... 160/236; 160/168.1 V; 160/173 V; 160/178.1 V

(58) Field of Search ..... 160/168.1 R, 168.1 V, 160/173 R, 173 V, 178.1 R, 178.1 V, 236

(56) References Cited

U.S. PATENT DOCUMENTS

| | | | | | |
|---|---|---|---|---|---|
| 1,632,219 | A | * | 6/1927 | Deller | 160/236 |
| 2,121,217 | A | * | 6/1938 | Ellis | 160/236 |
| 2,146,816 | A | * | 2/1939 | Grassby, Jr. | 160/236 |
| 2,603,286 | A | * | 7/1952 | Miao | 160/236 X |
| 2,757,727 | A | * | 8/1956 | Findell | 160/236 X |
| 3,012,318 | A | * | 12/1961 | Nelson | 160/236 |
| 4,236,566 | A | * | 12/1980 | Hensel | 160/236 X |
| 4,343,171 | A | * | 8/1982 | Kagawa | 160/236 X |
| 4,475,579 | A | * | 10/1984 | Bassett | 160/178 R |
| 5,409,050 | A | * | 4/1995 | Hong | 160/236 X |
| 5,573,054 | A | * | 11/1996 | Swopes | 160/236 |
| 5,657,806 | A | * | 8/1997 | Hung | 160/168.1 |

FOREIGN PATENT DOCUMENTS

| | | |
|---|---|---|
| AU | 9675406 | 2/1998 |
| CA | 601376 | 7/1960 |
| GB | 2303661 | 2/1997 |

* cited by examiner

*Primary Examiner*—Bruce A. Lev
(74) *Attorney, Agent, or Firm*—Dorsey & Whitney LLP

(57) ABSTRACT

A vane for use in either a vertical or horizontal slatted covering for an architectural opening is contoured so as to have a substantially j-shaped cross-section. A main panel of the vane has a shallow s-shaped configuration and an elongated edge of the vane is curved or hooked shaped and is adapted to be presented to the interior of a building structure to provide a soft appearance.

13 Claims, 5 Drawing Sheets

CONTOURED RIGID VANE FOR ARCHITECTURAL COVERING

BACKGROUND OF THE INVENTION a. Field of the Invention

This invention relates generally to coverings for architectural openings and, more particularly, to an improved vane for use in such an architectural covering wherein the architectural covering might be a window blind, door blind, or other such covering used in the interior of a building structure.

b. Description of the Known Art

Coverings for architectural openings have been used for centuries to selectively cover doors, windows, archways and the like. Coverings have taken numerous forms such as draperies, various types of curtains as well as slatted coverings such as venetian blinds and vertical blinds. Vanes or slats utilized in horizontal and vertical slatted coverings also have taken numerous forms, with horizontal slats typically having different characteristics than vertical slats.

Slats used in horizontal slatted coverings must be somewhat rigid so as to not bend along their length whereby they will retain a horizontal orientation without sagging. Typical horizontal slats are made of wood, aluminum, plastic or the like and are generally flat planar bodies. They may, however, have a slight curvature to prevent them from bending or sagging along their length.

Vertical slatted blinds are becoming more popular and typically have a headrail that contains a carrier mechanism, a tilt rod, and a plurality of operatively interconnected vertical slats or vanes. The carrier mechanism includes a plurality of hangers for individually suspending the vertical vanes. The carrier mechanism is coupled to the tilt rod so that when the tilt rod is rotated about its longitudinal axis, the hangers are caused to rotate about vertical axes which, in turn, rotate the vertical vanes to which they are attached about the same axes. The vanes are always hung from their top edge with the hangers usually being undesirably visible or requiring a valance to cover them up.

Vanes for vertical slatted window blinds are typically made with one or more of four different types of materials. These materials are fabric, polyvinyl chloride (PVC), aluminum and wood. The most common vanes are made from either fabric, PVC, or a combination of fabric and PVC. Fabric vanes offer a very appealing softer appearance which adds quality to the finished look of the vane. It also provides a designer with a number of design choices regarding the type of fabric to use for a particular room. PVC vanes are plastic and, therefore, have a harder plastic appearance. One advantage of the PVC vane, however, is its strength. PVC vanes can be laminated or wrapped with fabric to provide the PVC strength with the fabric appearance.

There are disadvantages, however, to vanes made of fabric, PVC or combinations thereof. Vanes made solely of fabric are thin, and tend to twist along their length when rotated from the top edge. They, further, are substantially two dimensional. PVC vanes, which are typically flat and planar in structure, also tend to twist along their length when rotated from the top edge. The PVC vanes are normally thin even though they can be molded to provide a three-dimensional shape.

Several hybrids exist for fabric vertical vanes. For example, fabric vanes are often treated with a stiffener to impart structural rigidity. The stiffener takes away the fabric's hand or softness but retains the look of the fabric. The vane will still twist, but less than non-treated fabric vanes. The treated fabric vanes also tend to curl in direct sunlight if the stiffener is not applied uniformly. Another hybrid, as mentioned previously, is a PVC vane laminated with the fabric. Such a vane has the structural strength and three dimensionality offered by a PVC vane with the appearance of a fabric vane. The fabric in this case also loses its hand or softness, however, and other problems common with PVC/fabric laminate vanes are that in sunlight, the fabric may curl and delaminate, there is increased assembly costs, the vanes are relatively heavy, and when the fabric is only laminated onto one face of the PVC, the reverse side is aesthetically displeasing. Another design includes a PVC vane core that is wrapped loosely with fabric. This provides a softer product with the fabric look, but it is very costly and difficult to fabricate. One other approach is a PVC vane with a groove along each edge so that a fabric insert can be positioned in and along the faces of the PVC vane. This approach is also costly, does not prevent longitudinal twisting and the reverse face in the grooved edges detracts from the fabric appearance. Another drawback with conventional vertical blind slats is that they typically have a cold appearance and do not simulate the softer and warmer look of curtains or draperies and this is to some degree due to the configuration of the slats.

Therefore, it is an object of the present invention to provide a new and improved vane for a window covering that will have a unique appearance when used horizontally, and will have the general appearance of a curtain when used vertically.

SUMMARY OF THE INVENTION

The vane of the present invention is contoured to provide a soft, drapery-like appearance when used in vertical coverings and to provide a new very distinct look when in horizontal coverings.

The slat in transverse cross-section is generally j-shaped having a main panel and a hook-shaped edge. The main panel has a shallow s-shaped cross-section and the hook-shaped edge is formed by folding one edge of a rectangular strip from which the slat is formed rearwardly upon itself. The edge which is folded rearwardly upon itself may form a smooth arcuate surface which may have a smaller radius of curvature than the radius of curvature of the s-shaped main panel. The folded edge, therefore, may simulate a pleat or fold in a curtain when the vane is suspended vertically and a smooth rounded edge of a slat when disposed horizontally. The radius of the folded edge can be varied to obtain different appearances and it does not necessarily have to be curved if different looks are desired.

Other objects, features and advantages of the present invention will become more fully apparent from the following detailed description of the preferred embodiment, the appended claims, and the accompanying drawings.

DESCRIPTION OF THE PREFERRED EMBODIMENT

Figure 1:
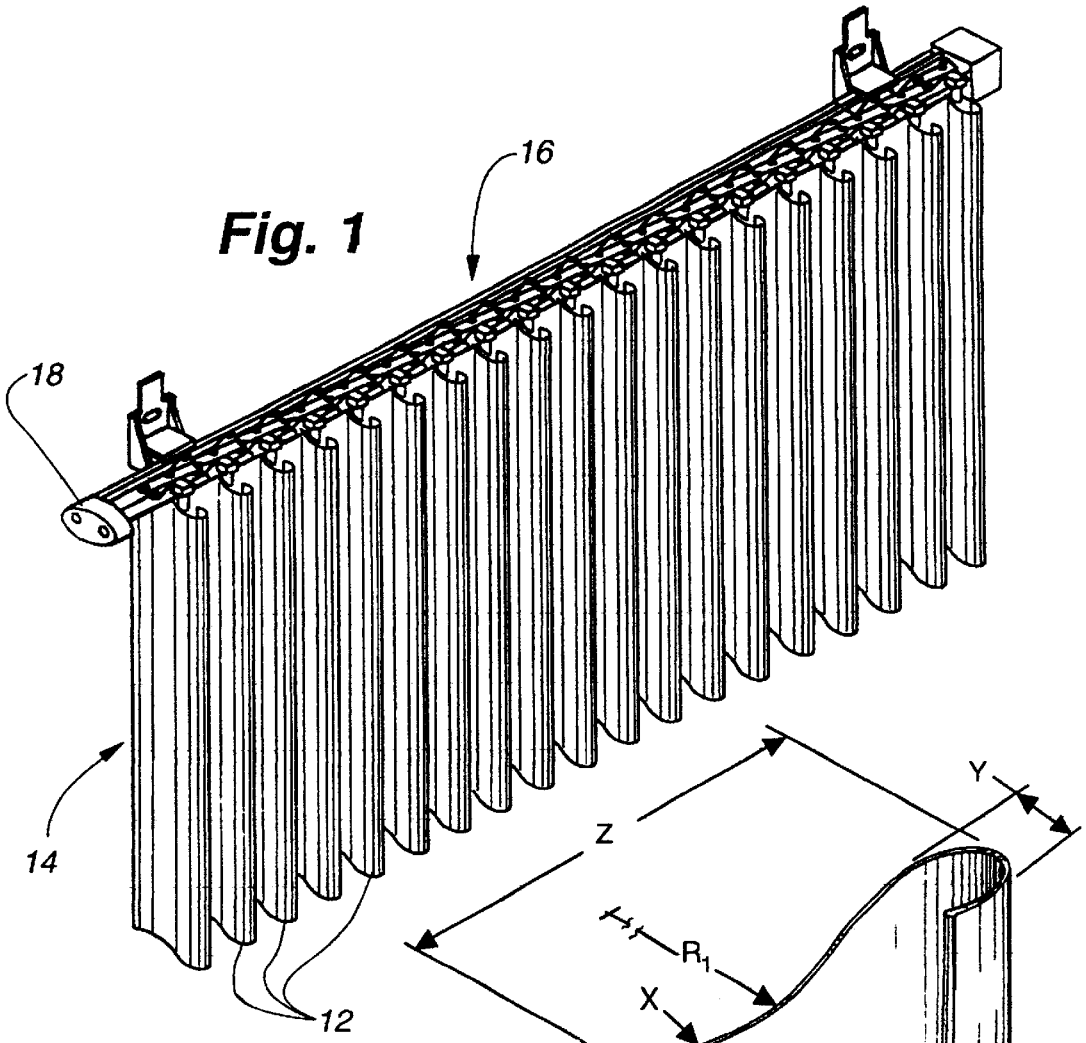
FIG. 1 is an isometric view of an architectural covering utilizing the vane of the present invention in a vertical orientation and with the covering closed but the vanes in an open position.

A plurality of the vanes 12 of the present invention are seen in FIG. 1 in a vertical vane architectural covering 14 even though the vane would also find uses in shutters, venetian blind coverings and the like. In the vertical vane use, the vanes are suspended from their top edge by a control system 16 that is disposed in a headrail 18 adapted to be mounted on a supporting surface adjacent to an architectural opening (not shown). The control system 16 for the covering 14 will not be described herein as it is not deemed important to the present invention but a description of a control system suitable for use in such a covering can be found in U.S. Pat. No. 5,626,177, which is of common ownership with the present application and which is hereby incorporated by reference.

Figure 4:
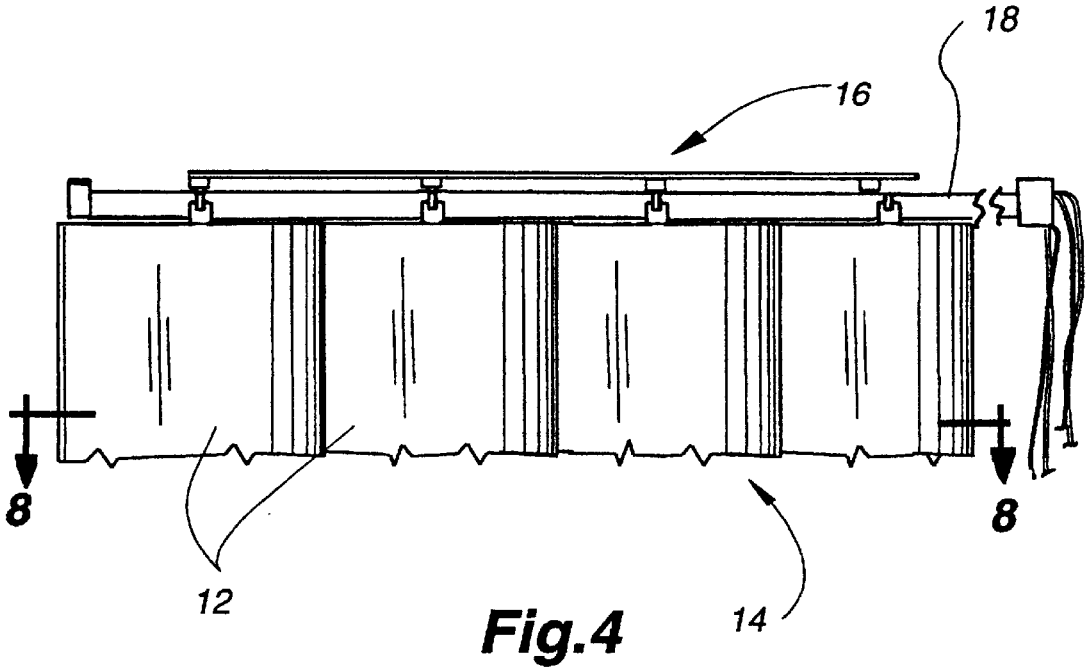
FIG. 4 is an enlarged fragmentary front elevation similar to FIG. 3 with the covering in an extended position, but showing vanes in accordance with the present invention in a closed overlapping relationship.

Vertical vane architectural coverings are characterized by a plurality of side-by-side vanes that are suspended from their top edge so as to hang vertically in parallel relationship. The afore-noted control system 16 is adapted to slide the vanes linearly along the headrail 18 between an extended position of the covering 14 as illustrated in FIG. 1, wherein the vanes 12 are evenly distributed across the architectural opening, and a retracted position of the covering, as depicted in FIG. 7, wherein the vanes are stacked in contiguous side-by-side relationship adjacent one or both sides of the architectural opening. The control system 16 determines whether the vanes will be stacked adjacent one side or both sides of the architectural opening, and this is a matter of choice. The control system 16 also is adapted to rotate the vanes 12 about a longitudinal axis between an open position of the vane as illustrated in FIGS. 1, 3, 6, and 7 and a closed position of the vane as illustrated in FIGS. 4 and 8. It will, therefore, be appreciated that the covering can be disposed in an extended position with the vanes 12 in an open position, as in FIGS. 1 and 3, or with the vanes 12 in a closed position, as in FIG. 8, or the covering can be positioned in a retracted position, as shown in FIG. 7, and when in the retracted position, the vanes 12 are preferably in an orientation at least close to the open position but in contiguous side-by-side relationship.

Figure 2:
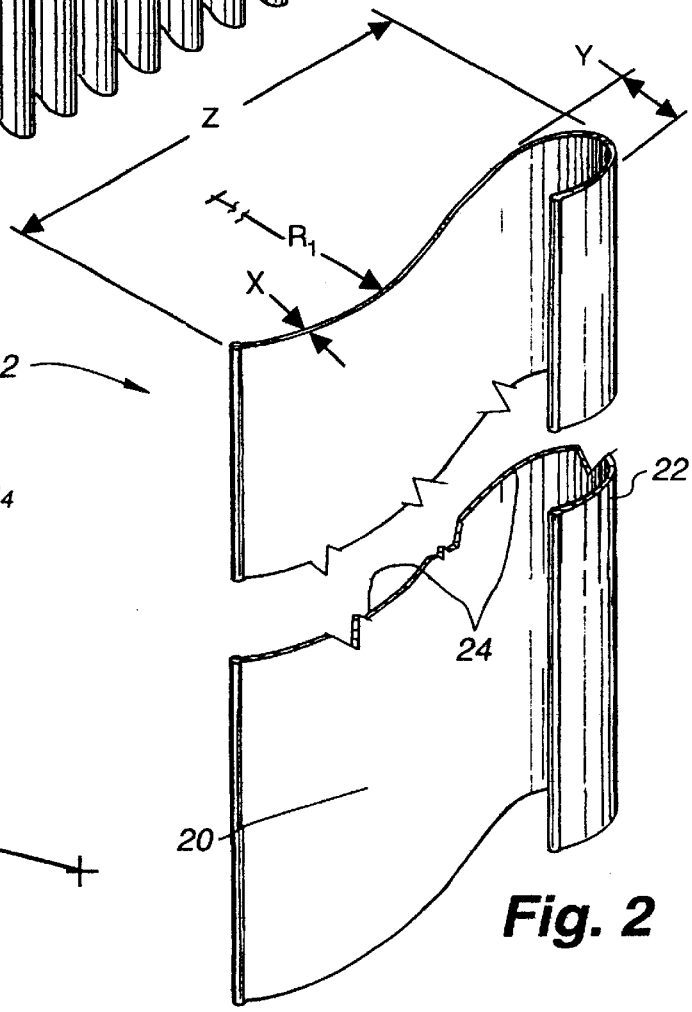
FIG. 2 is a fragmentary isometric view of the vane of the present invention.

The vane 12 of the present invention, as probably best illustrated in FIG. 2, is made of a substantially rigid material such as polyvinyl chloride or metal so as to substantially maintain its configuration regardless of its special orientation. It has a length, when used in a vertical vane covering 14, adequate to cover the height of the architectural opening in which the vane 12 is suspended.

The vane 12 is formed from a rectangular strip of material (not shown) having longitudinal edges. The strip is formed transversely so as to have a transverse cross-section that is substantially j-shaped. Alternatively, the vane 12 can be extruded into its final j-shaped cross-section. The vane 12, therefore, includes a main panel 20 and a hook-shaped edge 22. The main panel 20 preferably is of somewhat shallow s-shaped cross-section defining two reversed curves 24. The curvature of each curve 24 of the s-shaped main panel has a relatively large radius $R_1$, which is preferably in the range of 1 inch to 3.5 inches. Of course, the curvature is concave in one direction adjacent a first side of the vane 12 and concave in the opposite direction along a second or opposite side of the vane 12. The curvature of the concave sections of the main panel 20, may be approximately the same or could be different. While the depth of the s-shaped curve in the main panel 20 can be varied, it is preferable that 50% of the curvature is in one direction and 50% of the curvature is in the opposite direction.

The hook-shaped edge 22 of the vane 12 is formed by folding one edge of the strip of vane material rearwardly upon itself and preferably in a curved or arcuate manner, with the curvature of the fold being substantially elliptical. The vane 12 preferably has a depth Y (see FIG. 2) in the range of ⅛ inch to ½ inch, and preferably a width Z in the range of 1 inch to 6 inches. While the thickness X of the material from which the vane is made could vary, it is preferably relatively thin and in the range of 30 mm to 50 mm. The hook shaped edge of the vane does not have to be curved if other looks were desired such as a squared off or u-shaped edge but in the illustrated embodiment it is elliptical in configuration.

Figure 2A:
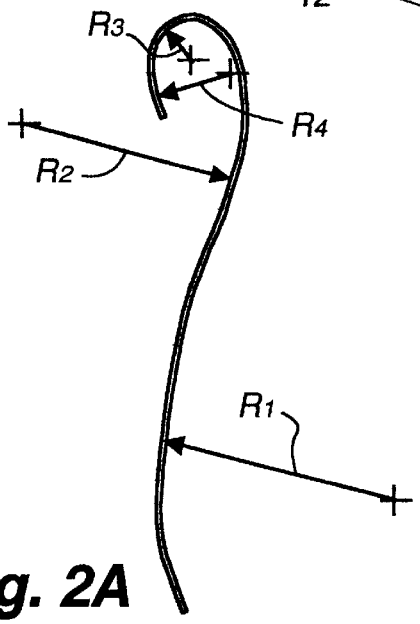
Figure 3:
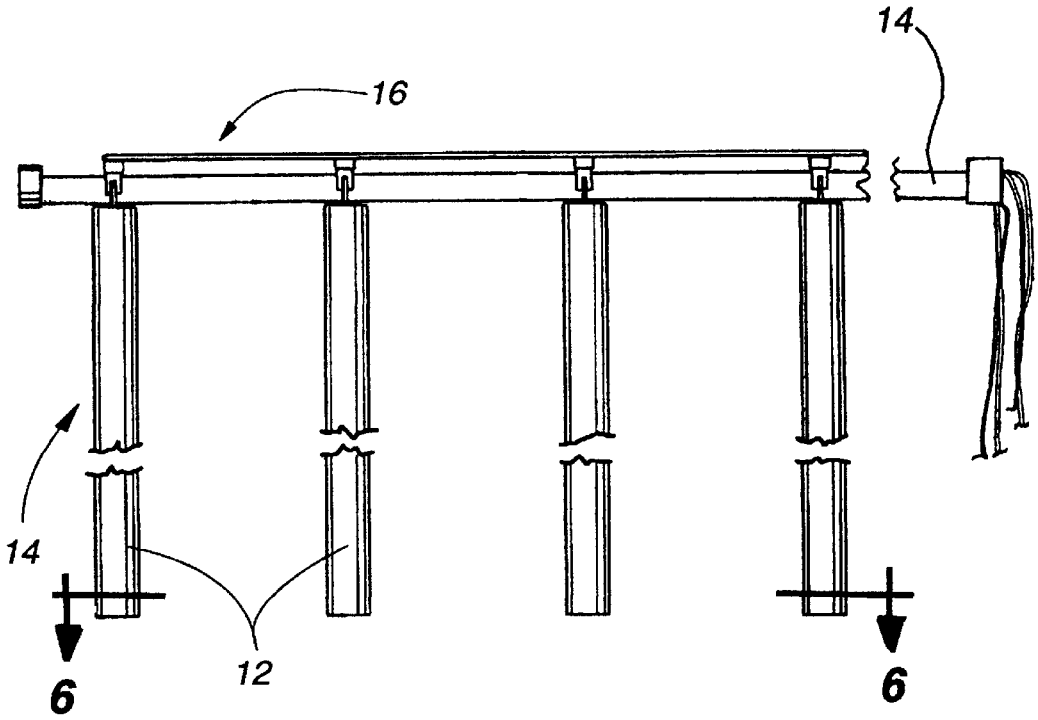
FIG. 3 is an enlarged fragmentary front elevation with parts removed illustrating the covering as shown in FIG. 1 in an extended position and with the vanes in an open position.

An alternative embodiment that is slightly different from that shown in FIG. 2 is shown in FIG. 2A. In the embodiment of FIG. 2A, the s-shaped main panel 20 has a first curve of radius $R_1$ and a second curve of $R_2$. The curves are in opposite directions so as to define convex surfaces on opposite sides of the main panel 20. The curvatures $R_1$ and $R_2$ may be the same or different. By way of example, the radius $R_1$ may be in one embodiment 2.75 inches and $R_2$ 1.0 inches. The hooked-shaped edge 22 of the vane 12 is again formed by folding one edge of the strip of material rearwardly upon itself in a curved or arcuate manner, instead of it being elliptical as shown in FIG. 2. The hooked-shaped edge 22 of the vane 12 might define two radii $R_3$ and $R_4$. By way of example of one embodiment, $R_3$ might be approximately 0.575 inches, and $R_4$ might be approximately 1.0 inch. Of course, the precise dimensions mentioned are not critical and would vary depending upon the size of the vane but the mentioned dimensions have been found to give a desired overall appearance for the vane.

It will be appreciated that the vane 12 assumes a contoured appearance that is aesthetically pleasing to the eye, and due to the curved edge 22 of the vane formed by the reverse fold in the strip of vane material, the vane 12 when used in a vertical vane covering 14 renders a drapery-like look to the covering 14 casting desired shadows. The curvature of the vane also improves the control over light passing through the vane as shown in FIG. 8 where it can be seen that the curvature is complementary between adjacent vanes to seal out light. Of course, the vane 12 would normally be suspended from the control system 16 with the curved edge 22 directed toward the interior of the building structure in which the covering 14 is mounted.

Figure 6:
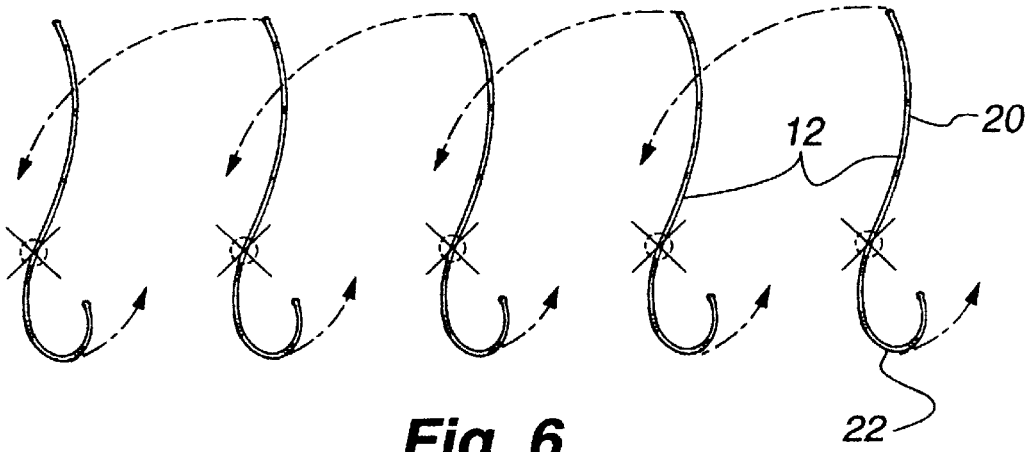
FIG. 6 is a diagrammatic top plan view along line 6—6 of FIG. 3, showing the architectural covering utilizing the vane of the present invention in an extended position and with the vanes in an open position.
Figure 7:
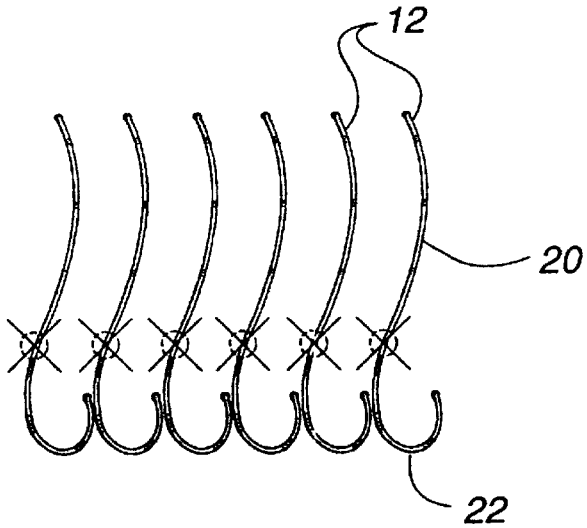
FIG. 7 is a diagrammatic top plan view similar to FIG. 6 with the covering in a retracted position and the vanes in an open position.
Figure 8:
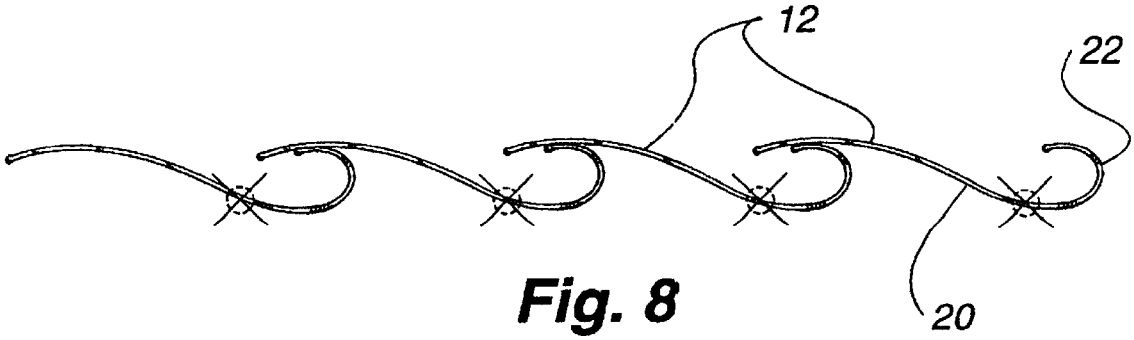
FIG. 8 is a diagrammatic top plan view along line 8—8 of FIG. 4, showing the architectural covering in an extended position but the vanes in a closed position.

Referring to FIGS. 6 through 8, the relationship of the contoured vanes 12 in the various positions of the architectural covering 14 can be seen. For example, in FIG. 6, the covering 14 is closed across the architectural opening but the vanes 12 are in an open position so as to define spaces therebetween through which vision and light can pass. The aesthetic appearance, however, to one interiorly of the building structure is similar to a sheer drapery or curtain in a closed position in that the rounded edge 22 of the contoured vane 12 simulates a fold or pleat in the curtain while vision and light is permitted between the rounded edges 22 of adjacent vanes similarly to how it would be permitted through sheer fabric. FIG. 7 shows the contoured vanes 12 in an open position but wherein the covering 14 itself has been moved to a retracted position so that now the vanes 12 are positioned in contiguous, side-by-side, horizontally stacked relationship, which is the position they would normally assume when the covering 14 is extended.

Again, it should be appreciated that the curved or hook-shaped edges 22 of the vanes 12 simulate the folds or pleats in a curtain or drapery when the curtain or drapery is extended or retracted so as to cast desired shadows, which distinguishes the contoured vane 12 of the present invention from other vertical vane systems.

FIG. 8 illustrates the vanes 12 in a closed position and with the covering 14 itself in an extended position, and there it will again be appreciated that the vanes 12 present a curved surface to the interior of the building structure as would appear with most curtains or drapes due to the s-shaped configuration of the main panel 20 of the vanes 12 and the curved interiorly directed edge 22. It should also be appreciated that the vanes 12 overlap in the closed position so that vision and light is blocked through the covering 14.

Figure 5:
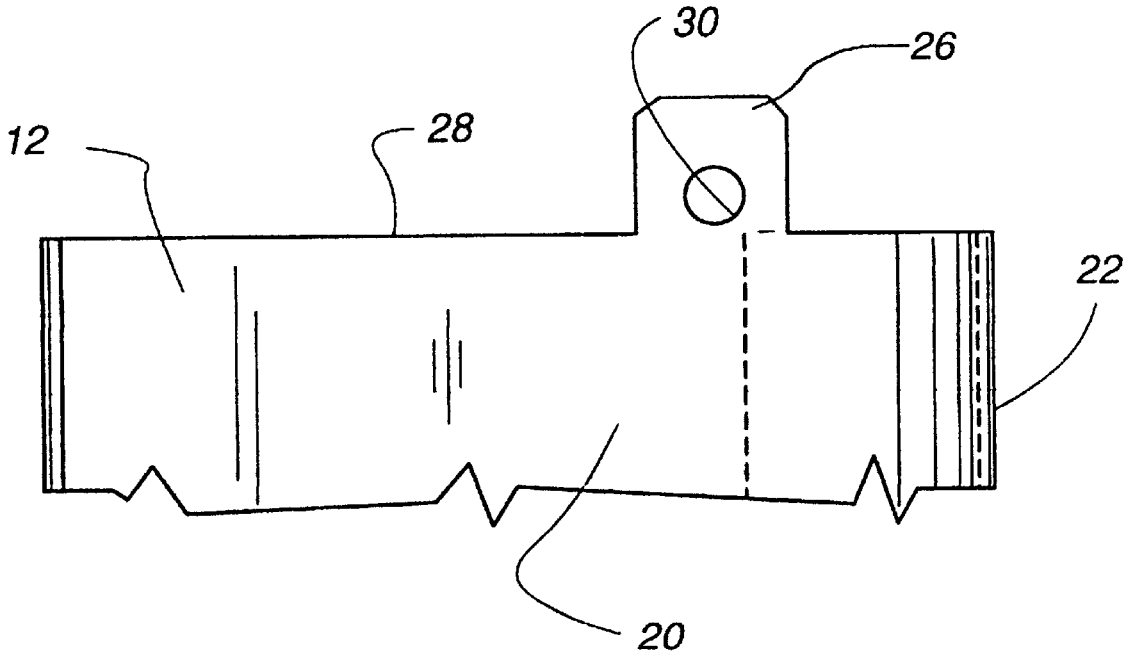
FIG. 5 is a fragmentary side elevation of the top edge of a vane of the present invention having a suspension tab formed thereon.

Numerous systems have been devised for suspending vertical vanes 12 in vertical vane architectural coverings 14, with some such systems merely utilizing a clip that grabs the top of the vane, or punching a hole in the top of the vane but others require a tab 26 (FIG. 5) on the top having an opening 30 therein adapted to receive a hook (not shown) on the control system 16 for the covering 14 for suspension of the vane 12. FIG. 5 illustrates a vane 12 of the present invention for use where a tab 26 is required and as will be appreciated, it simply consists of an integral extension from the top edge 28 of the vane 12, with the tab 26 having a much narrower width than the width of the vane 12 and having an opening 30 therein to receive the hook of a conventional control system. It should be appreciated, however, that the tab may not be necessary with the system for suspending the vane being dependent on the control system with which it is used.

Figure 9:
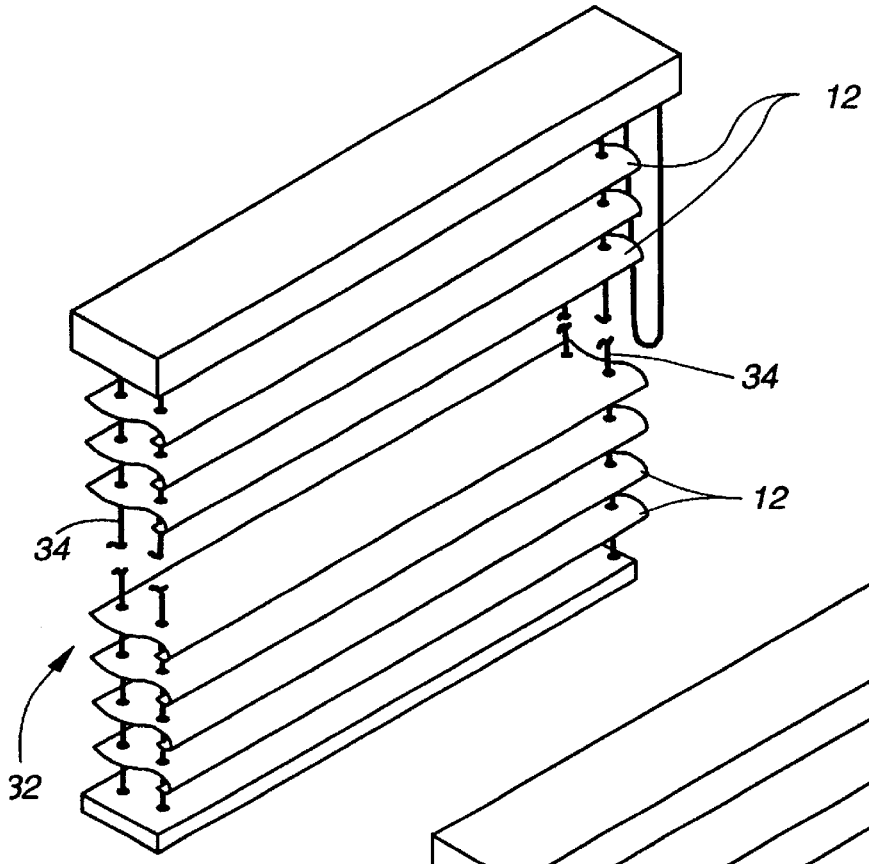
FIG. 9 is a fragmentary isometric showing the vane of the present invention utilized in a horizontal slat-type covering and with the covering in an extended position and the vanes in an open position.
Figure 10:
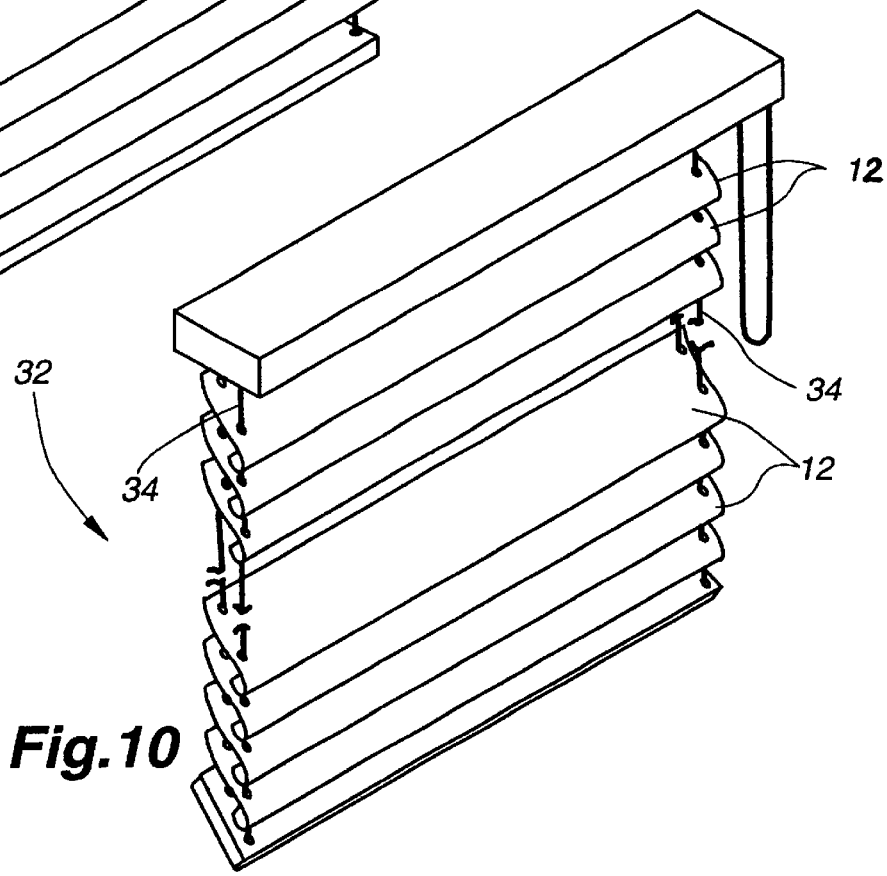
FIG. 10 is a fragmentary isometric similar to FIG. 9 with the covering in an extended position but the vanes in a closed position.
Figure 11:
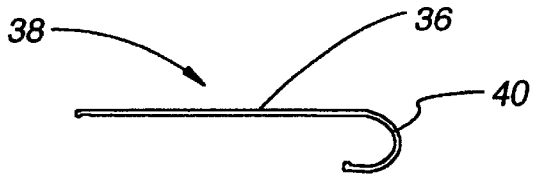
FIG. 11 is an end elevation of an alternative embodiment of the present invention.

The vane 12 of the present invention is shown in FIGS. 9 and 10 in use in a horizontal-type slatted architectural covering 32 commonly referred to as a venetian blind. The vanes or slats 12 are suspended at horizontally spaced locations along their length by conventional tape or cord ladders 34 thereby leaving the slats 12 unsupported along substantial portions of their length. Venetian blind-type coverings 32 are designed so that the blind can be raised in a retracted position with the vanes or slats 12 vertically stacked adjacent to the top of the architectural opening or lowered into an extended position, with the slats 12 being disposed in vertically spaced relationship along the height of the architectural opening. Through manipulation of the tape or cord ladders 34 in a conventional manner, the vanes 12 can be rotated about horizontal axes between open (FIG. 9) and closed (FIG. 10) positions when the covering 32 itself is in the extended position. In the extended position of the covering 32 but the open position of the vanes, as illustrated in FIG. 9, it will be appreciated that there are gaps between the vanes 12. But in the extended position of the covering 32 and the closed position of the vanes 12 as illustrated in FIG. 10, no vision or passage of light is permitted through the covering 32. The use of the contoured slats 12 of the present invention in a horizontal vane covering, of course, provides a different aesthetic appearance from conventional horizontal slatted coverings due to the curvature and thickness of the edge 22 of the vane 12 which is presented to the interior of the building structure but desired shadowing is obtained. The general j-shaped cross-section provides strength along the length of the slats so that they do not sag. For some horizontal covering applications, the main panel portion 36 of the slat can be flat, rather than s-shaped, as shown in the embodiment 38 of FIG. 11 but the curved edge 40 again provides rigidity to prevent sagging. For horizontal use, the slat would preferably have a width in the range of 2 inches to 3½ inches and a maximum depth in the range of 0.2 to 0.6 inches.

While the present invention has been disclosed in connection with a preferred embodiment thereof, it should be understood that there may be other embodiments which fall within the spirit and scope of the invention as defined in the following claims.

What is claimed is:

1. An architectural covering comprising in combination:

a head rail; and a plurality of adjacent vanes hung from the head rail, wherein each vane comprises an elongated substantially rigid body having a substantially j-shaped transverse cross-section defining a main panel and a single elongated edge having a hook-shaped configuration, whereby when the covering is moved between opened and closed positions, adjacent vanes do not undesirably hook one another.

2. The covering of claim 1 wherein said main panel is of substantially s-shaped cross-sectional configuration.

3. The covering of claim 2 wherein said hook-shaped edge defines a smooth arcuate surface.

4. The covering of claim 1 wherein said main panel is substantially flat.

5. The covering of claim 4 wherein said hook-shaped edge defines a smooth arcuate surface.

6. The covering of claim 1 wherein said hook-shaped edge defines a smooth arcuate surface.

7. The covering of claim 1 wherein said body is formed from a substantially rectangular strip of material having opposed elongated edges and said hook-shaped edge of said body is formed by folding one of said elongated edges of said strip rearwardly upon itself.

8. The covering of claim 1 wherein said vane is made of polyvinyl chloride.

9. The covering of claim 1 wherein the material from which the vane is made has a thickness and the thickness is in the range of 30 mm to 50 mm.

10. The covering of claim 1 wherein said body has a depth and the depth of said body is in the range of ⅛ inch to ½ inch.

11. The covering of claim 1 wherein said body has a width and the width of said body is in the range of 1 inch to 6 inches.

12. The covering of claim 1 wherein said vane is suspended vertically.

13. The covering of claim 1 wherein said vane is suspended horizontally.

* * * * *